US006095351A

United States Patent [19]

Rössler

[11] Patent Number: 6,095,351

[45] Date of Patent: Aug. 1, 2000

[54] COUPLING DEVICE FOR MODEL RAILWAY

[76] Inventor: Elfriede Rössler, Jakob-Auer-Strasse 8, A-5033 Salzburg, Austria

[21] Appl. No.: 09/070,469

[22] Filed: Apr. 30, 1998

[30] Foreign Application Priority Data

May 2, 1997 [AT] Austria ..... 764/97
Jan. 12, 1998 [AT] Austria ..... 25/98

[51] Int. Cl.[7] ..... B61G 5/00

[52] U.S. Cl. ..... 213/75 TC

[58] Field of Search ..... 213/211, 75 R, 213/75 TC, 75 D

[56] References Cited

U.S. PATENT DOCUMENTS

| | | | |
|---|---|---|---|
| 3,659,725 | 5/1972 | Passalacqua | 213/75 TC |
| 5,423,439 | 6/1995 | Richter | 213/75 TC |
| 5,775,524 | 7/1998 | Dunham . | |
| 5,826,736 | 10/1998 | Weber | 213/75 TC |

FOREIGN PATENT DOCUMENTS

| | | |
|---|---|---|
| 184 110 | 12/1955 | Austria . |
| 29 17 002 | 11/1980 | Germany . |
| 19612263C1 | 3/1997 | Germany . |
| 1 566 755 | 5/1980 | United Kingdom . |

OTHER PUBLICATIONS

Firm Viessmann catalog page (Kompaktantrieb) ( no date).

*Primary Examiner*—Mark T. Le
*Attorney, Agent, or Firm*—Alston & Bird LLP

[57] ABSTRACT

The invention relates to a coupling device (1,2) for model railways (3) where two model vehicles are connected and disconnected automatically with a closing element (12) and at least one coupling head (11); in the coupled state of the two coupling devices (1,2), the coupling head (11) of one coupling device (1,2) engaging the closing element (12) of the other coupling device (1,2) from behind and vice versa. In the coupling device (1,2) or in the vehicles (4,5) bearing the latter, especially model vehicles, an adjustment device (23) is arranged, with which the coupling head (11) and/or the closing element (12) of the coupling device (1,2) are adjustable relative to one another.

13 Claims, 9 Drawing Sheets

4
115
16
113
13
114
1
11
15
59
112
60
12
14
19
6

4
28
26
27
1
6
19
14
12
15
7
13
22
17
25
8
23
21
11
24
18
58

4
23
81
82
83
84
111
89
109
87
1
13
11
14
110
18
86
24

COUPLING DEVICE FOR MODEL RAILWAY

BACKGROUND OF THE INVENTION

1. Field of the Invention

The invention relates to a coupling device for model railways where two model vehicles are connected and disconnected automatically with a closing element and at least one coupling head; in the coupled state of the two coupling devices, the coupling head of one coupling device engaging the closing element of the other coupling device from behind and vice versa.

2. The Prior Art

A coupling device for model railways where two model vehicles are connected and disconnected automatically by a element and at least one coupling head is already known according to DE 196 12 263 C1. This coupling device comprises a coupling head, which engages into a recess of the coupling device or coupling head of the opposite facing coupling device, the coupling heads thus being in contact electrically with the connecting coupling devices in their connected state, and are constructed as electrically conductive compact strips. Using this design a simple conductive connection is indeed produced between the individual vehicles of a train system in a model railway, but additional manipulation is required for separating the coupling devices of two model railway vehicles from one another.

Furthermore, an actuating mechanism which has two magnetic coils is known from the catalogue 97/98 of Fa. Viessman, P.5, flat spiral springs transferring the force of the magnetic coils onto a brake piston. The brake piston has therefore a damping effect on the actuating mechanism. The disadvantage in this actuating mechanism is primarily the complicated construction. In addition this actuating mechanism is not suitable for all movements.

Experiments with modem technological materials have also been carried out, such as with multi-layer materials or memory metals as well as elements of the type known from sensor technology even with piezo-elements. Since the costs for the development and also the creation of the parts are very high, their use in the sphere of model construction is still at least presently not possible.

SUMMARY OF THE INVENTION

The object underlying the present invention is to create coupling devices which, when arranged at any point on the train system, enable the coupling connection between two such coupling heads to disconnect independently.

This object of the invention is achieved by the coupling device, wherein in the coupling device or in the vehicles bearing the latter, especially model vehicles, an adjustment device is arranged, with which the coupling head and/or the closing element of the coupling device are adjustable relative to one another. The advantage here is that the adjustment device is arranged at least partly in the coupling device and this makes possible a relative adjustment of the coupling head and/or of the closing element of the coupling device, so that the coupling heads of the coupling devices, facing one another during the coupling procedure, may be disconnected from one another easily. The advantage here is that it is also possible in this way to use known coupling heads and/or closing elements for coupling devices, for example in accordance with the U-shaped couplings which are extensively used in the market place, so that vehicles with coupling devices which are designed according to the invention can be coupled with such vehicles in a model railway which do not yet have coupling devices of this sort.

An embodiment is of advantage that in order to uncouple both coupling devices the closing element of each coupling device can be lowered by the adjustment device into an uncoupling position relative and perpendicular to the vehicle base. It is of advantage that since the loads affecting the closing element even with two coupling devices, which are in contact with one another, for example at a curve in the line of a rail system, are laden and twisted by only relatively small forces, so that for actuating the closing element with a small force a solution is possible and the coupling heads of both coupling devices release with greater certitude and are thus thus more simply uncoupled.

It is of advantage that the closing element of the coupling device can be adjusted by the adjustment device from the uncoupling position into its coupling position. Moreover it is of advantage that the coupling device has a coupling housing, which is formed from two parts, both parts of the coupling device surrounding a hollow space. Further is of advantage that both parts of the coupling device are connected to one another via a locking connection. An advantageous design of the coupling device is characterised in that on one of the two parts of the coupling housing, the coupling head particularly is positioned rotatably. Further is of advantage that the coupling head is formed by a coupling bow. Also is of advantage that on one of the parts of the coupling device, a retainer for the coupling head is formed or situated so that it can swivel. Further is of advantage that the adjustment device forms a constructional unit which is arranged in the hollow space of the coupling housing. Of advantage is also that the adjustment device has a movably located sliding lever with a carrier and a sliding element which operates together with the carrier.

Further is advantageous that the sliding element is formed from an extendable covering, especially from a plastic covering and from a liquid which is arranged in the sleeve. The advantage is that micro-components can be used here, which are already used in large-scale production for all sorts of applications and hence also have high operational reliability besides a small spatial requirement.

Also of advantage is that the sliding element has an electrical heating element which is surrounded by a vapourisable liquid, especially a resistance element, which heats up the vapourisable liquid by an electrical control impulse, so that a vapour bubble is produced, the pressure impulse of which effects the sliding of the sliding lever without vapour escaping from the sliding element or out of the sleeve. This design makes it possible, to actuate or admit the coupling head or the closing element which also makes possible an adequate build-up of force and a displacement in the opposite direction.

Further of advantage of the coupling device is that the adjustment device has an element for producing a pressure impulse from extendable elements or electrorheological, magnetorheological, or electromagnetorheological liquids, shape memory metal alloys or thermo-bimetals. A further advantage is that the adjustment device is connected to the wheelsets of a travelling mechanism of a model railway vehicle via connection wires. Moreover of advantage of the coupling device is that a control device and/or a decoder is arranged in the connecting wires between the wheelsets and the adjustment device. An advantageous design is characterised in that the model vehicles are connected together via a connection wire and a control device is arranged in a vehicle and/or a powered vehicle and there are decoders in the vehicles. Also of advantage is that, for controlling the control device and the decoder, control signals provided with the electric power are superimposed on the vehicles or the powered vehicle. Of advantage is here that since with the latter it possible, by using components from micro-mechanics and micro-electronics, to produce coupling devices which are automatic and can be actuated from a distance and which can be produced with regard to appearance and scale in such a way that they do not change too severely the reproduction of the vehicles in the model railway which remains true to the original.

Further is of advantage that magnetic power, especially a magnetic field is increased in strength for producing relative movement in the direction of the relative movement between the coil and the operating element. It is also of advantage that, for uncoupling the coupling device, the actuating device is arranged on the vehicle, said actuating device consisting of a coil core and a coil bearer with a coil which is connected movably to a pulling bow or the coupling bow of the coupling device via an adjusting lever. Designs like this are of advantage, since, because of the design of the actuating device, a magnetic field is produced with a special configuration or with increased magnetic strength in certain areas. Furthermore it is feasible, using the actuating device according to the invention, to attain adjustment lengths of 2 mm to 12 mm, preferably 3 mm to 8 mm, e.g. with the necessary pulling power for uncoupling operations in the sphere of model railways and thereby to apply forces of over 8 grams. It is furthermore advantageous in this invention that, despite the smallest construction size, a surprisingly good ratio of length/force is achieved with only slight heating.

Also of advantage is that the coil core or the coil bearer of the coil is designed rod-shaped, preferably with a polygonal cross-section and in both front end regions projecting members are arranged in the direction of the operating element. However, a further design is also advantageous since a strong magnetic flux can thus be built up when appropriately directed.

Moreover is of advantage that the volume of one member is greater than that of the member which is arranged in the other front end region of the coil core. An embodiment is also possible in an advantageous way that, however, by means of which the pulling power can be specifically increased in a partial area of the magnetic field.

Further of advantage of the coupling device is that, in the region of the member with the smaller volume, a further member is arranged projecting from the coil core in the direction lying opposite the operating element. Also of advantage is that the end of the operating element which moves relative to the coil is assigned to the member with the greater volume. Of advantage is that the operating element is positioned via a swivelling hinge in the region of the member with the smaller volume in a swivelling manner. It is of advantage that the coil core or the coil bearer of the coil is made of solid material and the coil bearer has a roughly rectangular cross-section. So high magnetic force can be achieved using this embodiment variants of the actuating device. The advantage there is that both the vertical height as well as the vertical force can easily be changed if desired by the layout and the variation in the inductor core and/or the permanent magnet, as well as its arrangement.

Also of advantage is that a swivelling part at the front end region has a bearing plate which is offset at 90° and is located at the front end region of the coil bearer. This development permits simple storage of the operating element, also taking account of easy assembly.

Moreover is of advantage that the coil core or the coil bearer of the coil and/or the operating element are made of iron. Using this development, strong magnetic forces can be attained in the magnetic field with little residual magnetism. By means of this, large adjustment ranges with high adjustment forces can be achieved using conventional technologies and simple means.

Advantageous is a further embodiment so that the swivelling part has a film hinge which is formed especially by material attenuation. Of advantage is here, since by using only a change in materials a flexible effect may be achieved which has high durability and has a lower power requirement for a rotational or slewing movement.

It is advantageous that, between the coil and the operating element, a member of the swivelling part of the operating element is arranged in a direction parallel to the length of the coil core. In this further development the leg of the articulated part can be used at the same time as a spacer between the operating element and the coil to switch off any remaining residual magnetism to allow the operating element to be returned easily into the normal position.

Moreover it is advantageous that the member is constructed integrally with the bearing plate and in its resting position has an opening angle which is greater than 90°. The design is of advantage since with this, via the opening angle, the pre-tension, which is built up with the current supply to the coil during horizontal movement and hence also the return force can be established.

Also of advantage is that the member of the swivelling part extends from the bearing plate into the region of the member with the greater volume. In this development the operating element can be reliably disconnected at the end of the current activation of the coil.

Of advantage is also that the coil is wound round with coil wire, which has a wire size of 0.06 to 0.12 mm, preferably 0.07 to 0.1 mm and the winding has 12 to 30 positions, preferably 16. So a simple basic plan of the magnetic field and, in a corresponding shape of the coil, a magnetic field with a particular configuration can be achieved. The advantage there is that, besides using fewer components, higher performance can be achieved with less heating.

Further is advantageous that the coil core or the core bearer of the coil consists of two L-shaped angled iron parts. A further advantage of the coupling device is that end parts as well as retaining clamps for the coil are connected together via locking, snap-on or clip-on connections. An economically favourable mode of production for the actuating device can be achieved in using this advantageous developments.

Also of advantage of the coupling device is that the operating element is arranged outwith the coil in its magnetic field, preferably being able to swivel. The magnetic force can be better exploited in this design since the magnetic flux between the legs of the coil can be switched on by the operating element simply via the operating element.

Further is advantageous that the coil bearer at the front end region has a circuit board for connecting the coil wires to a connecting cable. A development like this is advantageous, since in this the voltage supply from the voltage supplier to the actuating device or coil can be disconnected very simply and a reliable electrical and mechanical connection can be guaranteed.

It is advantageous that the wire size for the coil is 0.04 mm to 0.1 mm, preferably 0.06 mm. This development is advantageous, since a relatively thin but in fact common wire can indeed be used so that the production costs, especially the rejection rate in the production of such coils, can be minimised.

Also of advantage is that the swivelling part is formed from a non-magnetic resilient elastic material, especially from beryllides. In order to restore the operating element without problem to the neutral normal position at the end of the voltage supply to the coil and to prevent the operating element from adhering to the core.

A further advantage of the coupling device is that the coil can be operated via an alternating current harmonic wave, for example with a frequency of 8 kHz. Delivery to the coil of a frequency enables an independent actuation of the actuation device which is independent of the basic current supply.

Further of advantage is that, during an alternating current operation for operating the coil, the alternating current has a direct current portion. Likewise, switching on of the coil in the actuating device during alternating voltage operation is however possible too in this design.

Further is advantageous that, in model railway construction, for the purpose of uncoupling the coupling device, the operating element actuates an adjusting lever or a connecting rod or a cable which is connected for example to a coupling bow. This development is advantageous when used for a coupling device in model railway construction, since even with a buckled vehicle system, because of the high operating power of the actuating device, it is possible to disconnect the coupling devices reliably.

Also of advantage is that the coil with the operating element is arranged on a vehicle, particularly on a powered vehicle of a railway model. This arrangement for an actuating device is advantageous. Because of the small construction it is possible, even while maintaining the exact appearance of the model vehicle, to accommodate this actuating device. This actuating device may of course be used not only for model railways but also for trams, trolley buses, model lorries or similar.

It is further of advantage that, in the region of an end position of the relative movement between the coil and the operating element, a permanent magnet is arranged, the polarity of which is variable, when current is applied, on the side facing the coil to the polarity of the coil on the side facing the permanent magnet. This development is advantageous, since in this, during current supply to the coil, an increase in the magnetic force occurs because of the effect of the permanent magnet, and hence a higher adjustment force can be achieved in the direction of displacement.

Further of advantage is that the permanent magnet is arranged at a distance to at least one of the front sides of the coil bearer. This further development is of advantage, since here an increase in the adjustment force can be effected specifically in the direction of displacement.

Also of advantage of the coupling device is that the coil core is designed as a guiding mandrel and the coilwith the coil bearer as a round magnet, particularly as a hollow cylinder. Advantageous is this development, since here the core for the coil need not be specially manufactured; instead the existing component can be used.

Of advantage is that the permanent magnet is arranged on one end of the guiding mandrel. For a compact construction for actuating devices in small construction, as required for model construction, this further development is of advantage.

Further of advantage is that the permanent magnet is arranged in a plane which is perpendicular to the longitudinal axis of the guiding mandrel and concentric to the longitudinal axis of the guiding mandrel and preferably is designed as a disc. An increase in adjustment force which is uniform over the cross-sectional area of the coil is achieved by this development.

Finally is of advantage that the permanent magnet is secured or held via an insulator or an air gap at a distance from the guiding mandrel which is made of metal. Good exploitation of the additional pulling power which is achieved by the permanent magnet is made possible by this development.

This type of actuating device can, of course, be used also for other vehicles or for moving vehicle parts, such as cranes, diggers, fire brigade ladders or also for current collectors.

BRIEF DESCRIPTION OF THE DRAWINGS

The invention is described in greater detail in the following with the aid of the embodiments portrayed in the drawings.

Shown are.

DETAILED DESCRIPTION OF PREFERRED EMBODIMENTS

Figure 1:
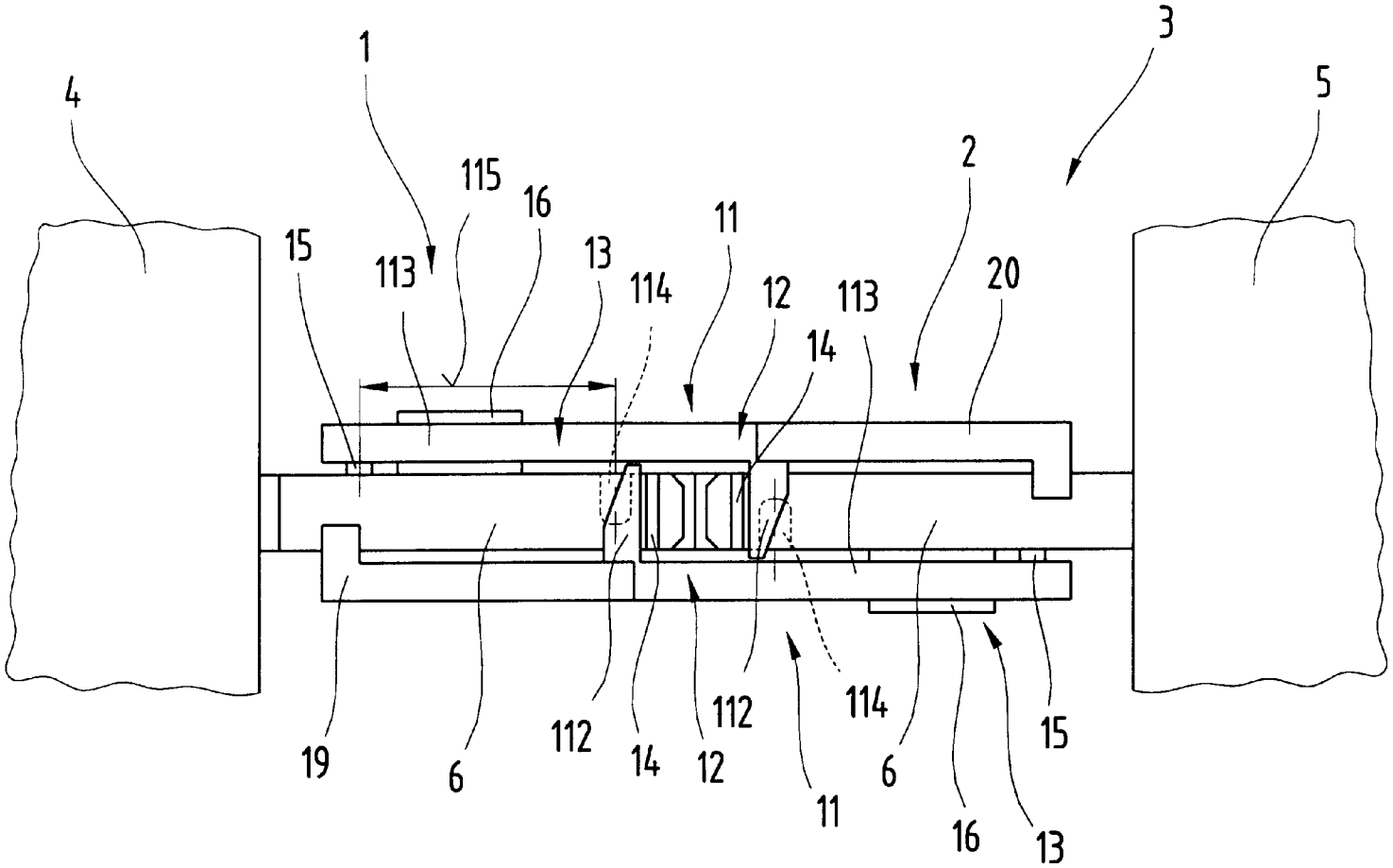
FIG. 1: two coupling devices according to the invention for model railway vehicles, in a coupled together state, plan view and simplified.

It should be established at the outset that, in the variously described embodiment forms, the same parts are provided with the same reference numbers or component descriptions, the presentations included in the entire specification being able to be transferred logically to the same parts with the same reference number or the same component descriptions. The positional descriptions, which have been selected in the specification, such as, e.g. above, below, sideways etc., also refer to the directly described and also represented Figures and should be transferred logically, if there is a change in position, to the new position. Furthermore, individual characteristics or combinations of characteristics of the various shown and described embodiments can also display in themselves independent or inventive solutions or solutions according to the invention.

In FIGS. 1 to 5 a coupling device 1,2 for model railways 3, especially for the vehicles 4,5 of the model railway 3 is shown.

The coupling device 1,2 is formed by a coupling housing 6, which preferably comprises two parts 7,8. Both parts 7,8 of the coupling housing 6 are preferably designed U-shaped, so that, when joining both parts 7,8 in the interior of the coupling housing 6, a hollow space 9 is created. The durable connection of both parts 7,8 of the coupling housing 6 can be constructed from any known state of the art attachment or connecting devices, as for example a catching connection 10 which is shown with dotted lines in FIG. 4.

In the coupling housing 6 or to the parts 7,8 of the coupling housing 6, the individual components for coupling the coupling device 1,2 are now arranged.

The coupling device 1,2 has thereby a coupling head 11 as well as a closing element 12. In the shown embodiment, the coupling head 11 is designed as a coupling bow 13 and the closing element 12 as an closing pin 14. The coupling bow 13 is thereby L-shaped and is located sideways on the part 8 of the coupling housing 6 via a rotational axis 15. The part 7 of the coupling housing 6 has in addition a supporting surface 16, on which the coupling bow 13 is supported and held at a preset spacing from the contact surface 18 of the vehicles 4,5 extending parallel to a vehicle base 17.

As can be seen, the coupling bow 13, when both connecting devices 1,2 are in operation as shown in FIG. 1 is pre-tensioned by a retainer 19 with a corresponding prestressed force in the direction of the coupling housing 6 of the coupling device 1.

This retainer 19 is likewise secured to the coupling housing 6 of the coupling device 1, this being made possible by gluing, screwing or a shaping procedure during the one-piece production of the coupling housing 6 or the part 7,8 of the same. The retainer 19 is for example produced from a plastic material with high memory behaviour, so that, as a type of prestressed leaf spring, it builds up a prestressed force in the direction of the coupling housing 6, by moving out of a horizontal plane i.e. in the direction in which the closing element 12 projects above the coupling housing 6.

Likewise, there is also a retainer 20 in the coupling device 2, which is likewise secured again to the coupling housing 6 of the coupling device 2 and serves to hold down the coupling bow 13 of the coupling device 1.

As can be seen furthermore from the illustrated representation in FIG. 1, the coupling bows 13 grip the closing elements 12 or closing pins 14 of the respective other coupling device 1,2, so that the pulling power in the locomotion of the train system consisting of the vehicles 4 and 5 can be transferred from one vehicle 4 to the other vehicle 5.

According to the direction of travel, one of the two coupling bows 13 operates thereby as a transmission means for pulling.

If the train system consisting of the vehicles 4,5 is pushed, both coupling housings 6 or parts formed onto the latter are supported preferably via a front wall 21 onto one another and can hence also transfer transverse forces via the coupling devices 1,2, without the coupling bows 13 and the closing elements 12 disengaging.

The coupling devices 1,2 are coupled together by pushing together the vehicles 4,5. Thereby, the coupling bows 13 are raised by a diagonal surface 22 which is arranged onto the coupling bolt 14 at a distance relative to the contact surface 18 so that the coupling bows 13 which are directed over the closing elements 12 and behind the latter or the closing bolt, engage; the retainer 19 or 20, while being moved upwards along the diagonal surface 22, being raised contrary to its direction of pretension until the coupling bows 13 move through between the latter and the closing pin 14 and catch behind the latter.

In order to disconnect the coupling devices 1,2 it has been normal up till now to provide projecting actuation levers on the coupling bows 13 in the direction of the contact surface 18, said actuation levers being raised by a raisable beam which was arranged between the rails of the model track in order to separate the set of wagons then from one another at the desired point by means of the relative movement of the vehicles 4,5 to one another.

According to the present invention however the unlocking of the two coupling devices 1,2 and the separation of the same should result from the adjustment devices 23, which are built into each coupling device 1,2 respectively.

In order for these adjustment devices 23 to begin operation, it is possible for example to steer the latter using known radio controls as have been known for a long time in model construction, especially in aircraft construction.

It is however equally possible, to make use of the digital control systems which have been known for a long time in the model railway sphere. The transference of digital signals for performing steering movements is modulated apart thereby from normal line current and the control signals can therefore be sensed with the power output of the rails in a model railway network.

In the present case then for example, all the wheelsets or individual wheelsets of the vehicles 4,5 are operated by electricity, so that for example on a so-called two-wire system the power and control signals of both rails in a model track can be continually taken up and further conducted via contacts into the interior of a vehicle 4,5. The wheelset 24 as well as the contact 25 and a connection lead 26 are shown greatly simplified and schematically only in FIG. 3 since they are known to any expert involved in this area in the various embodiment variants. Thus, it is also possible to use bearing bushes which are made of conductive plastic material in place of contacts, just as it is possible, for conducting signals or power into the plastic parts, to use integrated strip conductors or strip conductors which are deposited on the plastic parts.

The connecting wire 26 is connected inside the vehicles 4 or 5 to a control device 27, which for its part is connected via contact strips or connecting wires to the adjustment device 23 which is arranged in the coupling housing 6 in the present case. The control device can be provided thereby with a so-called decoder 28 for evaluating steering signals which are fed via the connecting wire 26, said decoder defining a certain destination for the adjustment device 23 and, only when this destination has been reached, activating the adjustment device 23 via the control device 27. The adjustment device 23 can then comprise various micro-actuation mechanisms. In the present embodiment, the micro-actuation mechanism is formed by several sliding elements 30 to 33 which are arranged behind one another in the direction of movement of a carrier 29 and the construction of which is described in detail in the following.

The carrier 29 operating together with the sliding elements 30 to 33 is connected to a sliding lever 34 or formed onto it, said lever being guided in openings 35 of a guide housing 36.

The sliding lever 34 is provided in the region of its front end which is facing the closing pin 14 which forms the closing element 12 with a thrust surface 37, which extends inclined diagonally to its longitudinal axis 38. This thrust surface 37 forms an angle less than 90° with a base surface 39 of the coupling housing 6. On this thrust surface 37, there lies a supporting surface 40 of the closing pin 14, extending likewise inclined towards the base surface 39, the angle which is formed between the supporting surface 40 and the base surface 39 corresponding preferably to that angle formed between the thrust surface 37 and the base surface 39.

The closing pin 14 is located for its part in a guiding rail 41 extending perpendicular to the base surface 37 of the coupling housing 6 and can be slid perpendicular to the vehicle base 17. In its position which is shown in FIG. 4 in unbroken lines, the closing pin 14 is situated in its coupling position 42, i.e. in the position in which the coupling bow 13 can engage said bolt in order to transfer pulling power.

Figure 4:
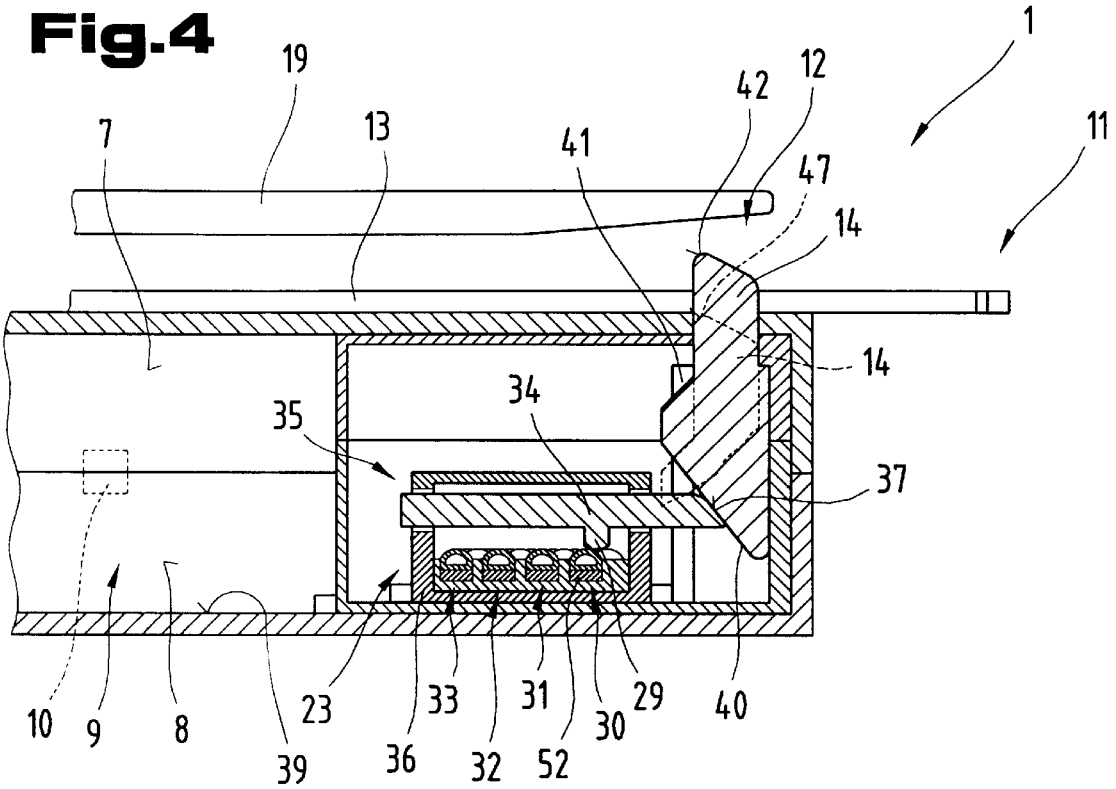
FIG. 4: a part of a coupling device according to the invention with the adjustment device which is assigned to said coupling device, in side view, sectioned and greatly simplified, schematic representation.

In order to hold the closing pin 14 in this position, the sliding lever 34 has a guiding surface 43, which runs up to a steering surface 44 in the end region of the guiding housing 36 in a position extending in the coupling position of the closing pin 14 so that the sliding lever 34 engages in a catching position, which is shown in FIG. 4 in unbroken lines, into a recess 45 in the bottom region of the guiding housing 36 or a carrier plate 46 for the sliding elements 30 to 33. In this way, the sliding lever 34 is fixed to stop it sliding in the direction of its longitudinal axis 38 and the closing pin 14 is also held in its coupling position.

In order now to separate the coupling device 1,2 and hence the two vehicles 4,5 from one another, it is necessary to lower the closing pin 14 now out of its coupling position 42 which is shown in unbroken lines into an uncoupling position 47, shown in broken lines.

When it becomes known then via the control device 27 that the coupling device 1 and the coupling device 2 are to be separated from one another, the sliding elements 30 to 33 as well as, if necessary, a further sliding element 48 and 49 are activated in the manner described in the following.

Sliding elements 48 and 49 are thereby arranged in the recess 45 and on the front wall of the guiding housing 36; the sliding element 48 being activated first.

Each of the sliding elements 30 to 33 and 48,49 comprises an extendable sleeve 50, especially a plastic material sleeve 50, and a liquid 51 arranged in the watertight sleeve and also a heating element 52 which is arranged in the space encircled by the sleeve 50.

If the heating element 52 of the sliding element 48 is switched on now by the control device 27, the vaporisable liquid 51 which preferably has an extremely low boiling point, is heated abruptly and vaporised. By means of the physically dependent increase in volume during conversion from the liquid to vapour-forming condition, a vapour bubble is formed which causes a pressure impulse and raises the carrier 29 from the uncoupling position, which is shown in unbroken lines in FIG. 5, into the raised intermediate position, which is shown in broken lines. Simultaneously or directly afterwards, the sliding element 49 of the same construction can also be activated, by means of which the sliding lever 34 is moved in the direction of its longitudinal axis 38 from the front wall 54 of the guiding housing 36, containing the sliding element 49 in the direction of the further sliding elements 30 to 33.

By rhythmic sequential directing of the sliding elements 30 to 33, the carrier 29 is then moved over a diagonal guiding surface 55,56 in the direction of a dotted-line arrow 57, i.e. into its uncoupling position. By pulling back the sliding lever 34—according to the dotted lined-arrow 57—the closing pin 14 drops perpendicular to the bottom surface 39 and is situated, if the carrier 29 is situated in the uncoupling position which is shown in dotted lines in FIG. 5, likewise in its uncoupling position 47, which is indicated in FIG. 4 with broken lines. Since the closing pin 14 is situated in this position within the coupling housing 6, it releases the coupling bow 13 and therefore the two vehicles 4,5 can move freely relative to one another after the closing effect between the closing pin and the coupling bow 13 has gone. If one of the two vehicles 4,5 is then dragged away by a powered vehicle or if a part of the train unit is removed by vehicle 4 from vehicle 5, vehicle 5 remains in its original position.

Figure 5:
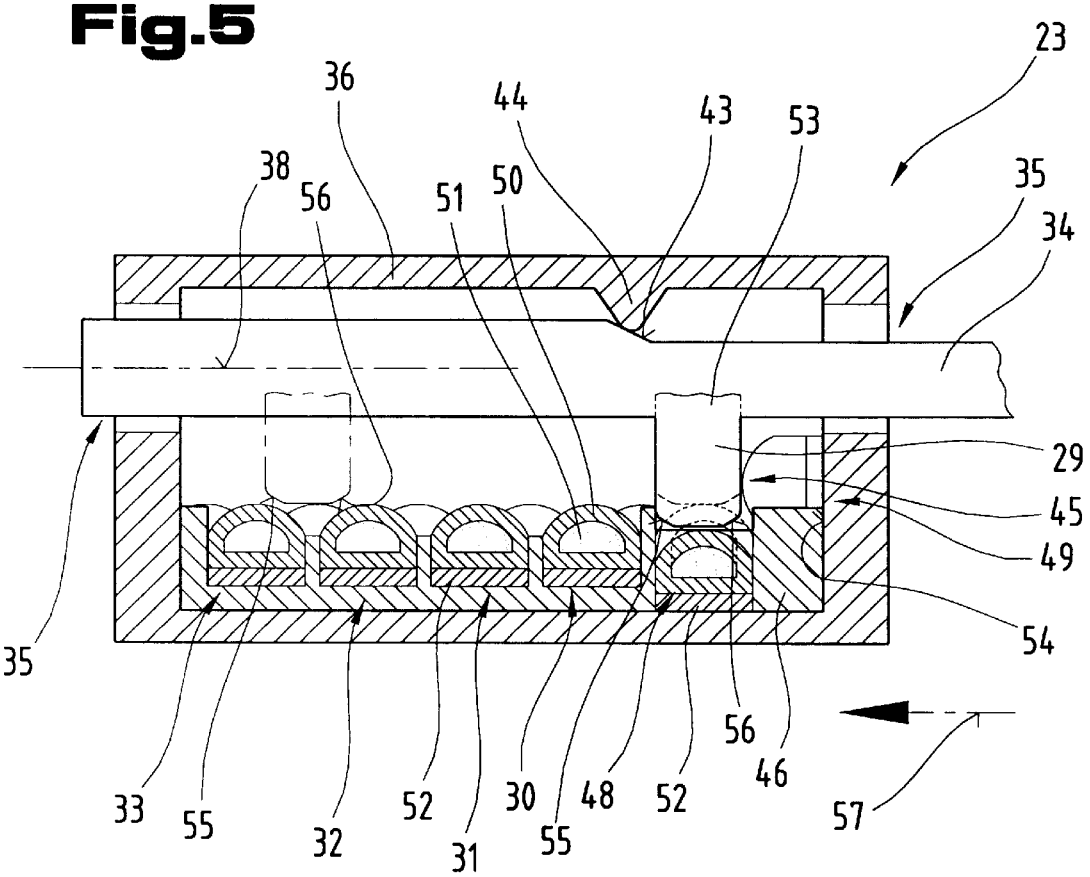
FIG. 5: the adjustment device according to FIG. 4, enlarged and in simplified, schematic representation.

When the uncoupling procedure is finished, it can be effected via a function initiation which is controlled by a time delay, that the sliding elements 33 to 30 are then switched on in reverse order beginning with sliding element 33, so that the carrier 29 then moves forward over its diagonal guiding surface 56 out of the uncoupling position shown in dotted lines into its coupling position which is shown in unbroken lines in FIG. 5 and hence, by means of the interaction between the thrust surface 37 with the supporting surface 40 of the closing pin 14, the latter is raised into its coupling position 42 which is drawn in unbroken lines, with the result that the coupling devices 1 and 2 respectively are sitting in preparation for coupling the vehicles 4,5 once again.

It is of course possible, even in the uncoupling position, to effect an interlocking connection of the closing pin 14 or the sliding lever 34.

It is of course also possible, while coupling the vehicles, to lower the closing pin 14 even during the coupling procedure in order to facilitate the coupling procedure and to reduce the necessary force required for coupling together light vehicles 4,5 for example and after successfully pressing the vehicles 4,5 together to set up the latter in the coupling position 42.

A design of this type for coupling devices 1,2 is also suitable in that the vehicle 4 with the new coupling devices 1,2 can be coupled with vehicles of older, traditional coupling systems, such as for example solid bow couplings which have been used for decades.

In those cases, however, a completely automatic uncoupling is not possible. However, in order, for example, to be able to undertake a coupling procedure when joining such vehicles to traditional uncoupling devices, the coupling bows 13 can be provided with actuating levers 58 which project in the direction of the contact surface 18, so that in this case even the automatically operating coupling devices 1,2 can be uncoupled with the traditional coupling devices.

Furthermore, it is of course also possible, to provide the coupling bows 13 and/or the retainer 19 respectively with their own adjustment devices 23 which can be actuated for example simultaneously or independently of the activation of the adjustment device 23 for the closing pin 14, in order to bring the retainer 19 and the coupling bow 13 also into an uncoupling position 47 as well as a coupling position 42.

This adjustment can result from linear raising, swinging upwards or folding away in the longitudinal direction of the vehicles or sideways.

In order to achieve a higher adjustment force for the sliding lever 34, the coupling bow 13, the closing element 12 and/or the carrier 29, several adjacent rows of sliding elements 30 to 33, 48,49 are also provided which are arranged in the direction of the longitudinal axis 38 and offset, or several rows like this of sliding elements 30 to 33, 48,49 are arranged which have an effect on the carrier 29 across the circumference of the guiding housing 36.

In the place of the shown heating elements 52, vibration generators for producing microwaves or similar can also be used for causing the liquid 51 to vaporise. Of course it is also possible, however, for other displacement systems for liquids 51 to be used to actuate the sliding elements 30 to 33, 48,49.

It is also possible for example to deliver the pressure impulses by means of externally supplied means which are under pressure, such as air or liquid from a reservoir, into these sliding elements 30 to 33, 48,49.

So that actuation of the coupling devices 1,2 which are connected to one another or sitting opposite one another can be achieved via a single control device 27, contact surfaces 59,60 are also provided in the region of the coupling devices 1,2, said surfaces coming into contact with one another, when the two coupling devices 1,2 are in operation, and the control signals and possibly the energy required for activating the adjustment devices 23 are transferred. The power can thereby result from the partly conductive design of the individual components of the coupling devices 1,2 for example in the coupling housing 6 and the coupling bow 13 or the closing pin 14 and similar can result or also because of the fact that strips of conductive materials can be affixed or vacuum deposited onto these parts, especially of the coupling housing 6, via which conductive materials the signals the energy from one vehicle 4 to the other vehicle 5 can be conducted via the coupling devices 1,2.

Figure 6:
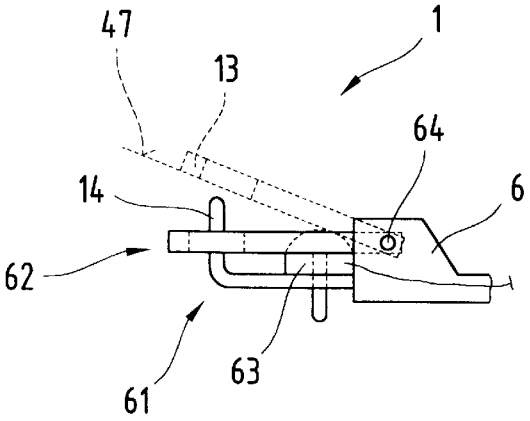
FIG. 6: another embodiment variant of the coupling device according to the invention in side view and schematic representation.
Figure 7:
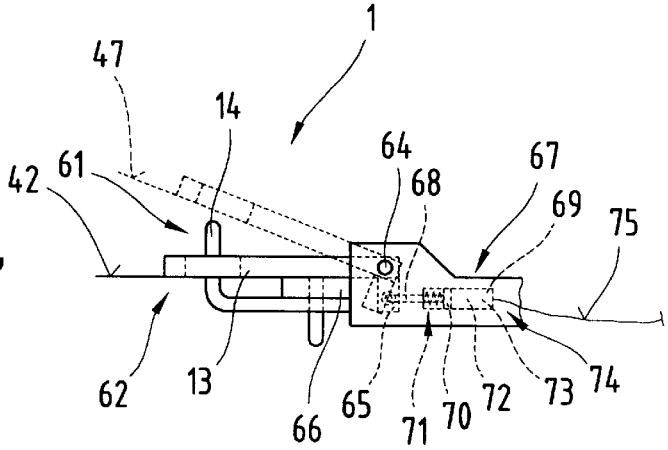
FIG. 7: a coupling device with an adjustment device according to the invention in side view and schematic representation.
Figure 8:
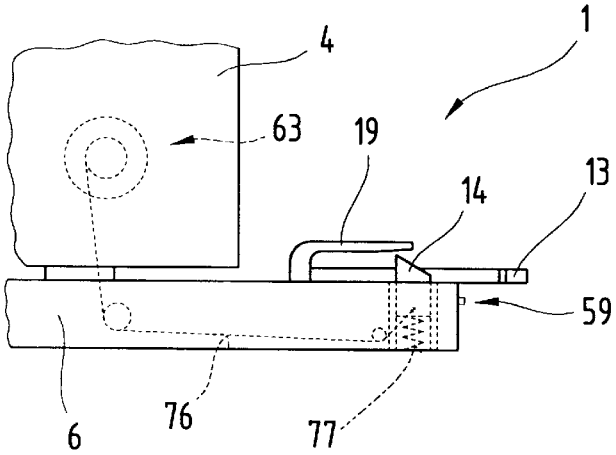
FIG. 8: another embodiment form of a coupling device according to the invention, in side view and greatly simplified, schematic representation.

In FIGS. 6 to 8 various variants 61,62 are known for producing adjusting movements in coupling parts 61,62, with which a pressure impulse can be exerted via an electric control impulse for displacing or moving one of the two coupling parts 61,62 sideways. An element 63 can thus be constructed for producing a pressure or extending impulse using an expanding material element or thermostatic bimetals.

However, the element 62 can, for example, be formed by an expanding shape memory metal also, which, as is shown in FIG. 6, extends similarly to an expanding material element or thermo-bimetal extending from the coupling part 61 in the direction of the coupling part 62 as is shown in broken lines and lifts up the coupling part 62, which can be designed as a coupling bow 13, into the uncoupling position 47 which is shown in broken lines by means of which the coupling bows 13 and the closing pins 14 disengage from two coupling devices 1,2 which are facing one another and were previously connected to one another and because of this the vehicles 4,5 which are provided with coupling devices 1,2 of this type can be separated from one another.

In FIG. 7 an embodiment variant is shown in which, to actuate the coupling part 62, which is designed for example as a coupling bow 13, said coupling part has a thrust arm 65 protruding via its swivelling axis 64.

In a coupling head 66 of the coupling device 1, there can be a piston-cylinder arrangement 67 which can exert a pressure on the thrust arm 64 with its piston rod 68 or in a diametrically opposed arrangement with its cylinder, to swivel the coupling part 62 out of its coupling position 42, which is shown in unbroken lines, into the uncoupling position 47 which is shown in broken lines. In addition, on the side of the piston rod 68 of the piston 70 which moves in the cylinder 69 there is a restoring spring 71 arranged and a cylindrical chamber 72 lying opposite it is filled with a fluid 73. The fluid 73 can be designed as an electro-rheological, magneto-rheological and electromagneto-rheological liquid. Electrochemical actuators within the cylindrical space could also be considered, and corresponding electrical transferring elements 74, which are connected to the control device 27 via wires 75, are also arranged in the cylindrical chamber 72.

In FIG. 8 an embodiment variant is shown, in which the thrust or pressure impulses in the vehicle 4, 5 are formed by corresponding elements 63 producing pressure or adjustment impulses which can be produced via micromechanical elements, for example sheathed cables, lever rods, wires with a power source, for example with a piezo crystal, an electric or electromagnetic servometer, piezoelectric, electrostrictive and photostrictive actuators or actuating mechanisms from fluid technology. Electronic pulse motors or similar can of course also be used which can be displaced relative to the coupling housing 6 or the coupling shaft, via sheathed cables 76, which can be adjusted against the effect of tension springs 77, via the closing pin 14 or via the coupling bow 13.

In the construction of the element 63 which is made of piezo crystals or thin layers which are built up sandwich-like, the movement or pressure impulse, which is produced by heating or otherwise supplying power, can likewise be used for moving the carrier 29 or the closing pin 14 or the coupling bow 13 or the retainer 19. For example, it is also possible to use materials in addition with high linear expansion during heating and which in bar or wire form can stretch in a longitudinal direction only when heated and which thus can effect a further movement or an adjustment of the previously mentioned parts.

For this purpose, thin layers are feasible, which are designed as bimetals, or also actuation wires or helices which are made of so-called shape memory alloys and which adopt a predetermined position when heated and can be deformed in any desired fashion when under mechanical stress.

Using elements of this sort it would be possible therefore for the actuation bow to be deformed in any desired fashion so that when heated the sliding elements adopt their originally defined form again and thereby effect the release of the coupling bows 13 or the closing pins or the retainers 19.

In order to make it possible to actuate the coupling devices 1,2 which are situated opposite one another or connected to one another via a single control device 27, contact surfaces 59, 60 may also be provided in the region of the coupling devices 1,2, which surfaces come into contact with one another, and the control signals and finally the power required for activating the adjustment devices 23 is transferred if the two coupling devices 1,2 are engaged. The power can result thereby from the partly electrically conductive design of the individual components of the coupling devices 1,2 for example of the coupling housing 6, the coupling bows 13 or the closing pins 14 or similar, or else by virtue of the fact that pathways of conductive materials may be affixed or vacuum-deposited onto these parts, especially of the coupling housing 6, via which pathways signals and power can be conducted from one vehicle 4 to the other vehicle 5 via the coupling devices 1,2.

Of course, any microcontacts, microswitches or similar or cordless transferring elements may be used between the individual vehicles 4,5.

Figure 9:
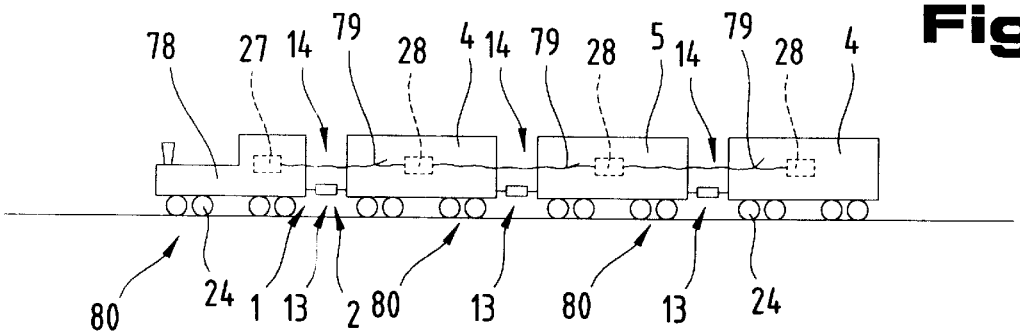
FIG. 9: a train unit made up from a powered vehicle and vehicles of a model railway with the coupling device according to the invention arranged in between the two and the steering elements which are assigned to the vehicles, in side view and greatly simplified schematic representation.

As is shown in FIG. 9, it can also prove useful, when using an electrical connection of this type in the individual vehicle 4,5 when they are coupled together, to arrange only one control device 27 in one of the vehicles 4,5 or in the powered vehicle 78 and to activate the coupling bows 13 via the individual sliding elements 30 to 33, 48,49 and/or the closing pins 14 via this central control device 27.

In such a case however, at least one decoder 28 would have to be arranged in each vehicle 4 or 5 for recognising the respective identification of the coupling device 1 or 2.

The transmission of these signals between the powered vehicle 78 and the vehicles 4,5 and between the vehicles 4,5 themselves could be achieved also however via for example connecting wires 79 or lighting wires—indicated schematically—which are arranged aligned to one another in their operating position and which may be arranged in the vehicles 4,5 or the vehicle bodies or underneath the vehicles 4,5.

In order to be able to realise a simple, at will uncoupling procedure at any point in a train unit, it is further advantageous if the individual control devices 27 in the individual vehicles 4,5 communicate with one another or with a central control unit or control device 27 in the powered vehicle without using wires or via corresponding connecting elements 79 or if said devices 27 are in contact with the rails of the model railway via wheelsets 24 of the travelling mechanisms 80.

In the assembly of a train unit it is hence possible for the control device in the powered vehicle or the central control device to register the vehicles 4,5 which are arranged on a section of track behind one another with their corresponding identification signals or the identification signals of the coupling devices 1,2 which interact successively, so that, in simple functions, as for example uncoupling the train after the third vehicle 4,5 an operation is possible without exact knowledge of the identification signals of the individual coupling devices.

In order to be able to coordinate the individual vehicles 4,5 exactly in a vehicle unit, it is also advantageous if sensors are arranged on the vehicles 4,5 in the region of the individual coupling devices 1,2 or between the coupling devices 1,2 with which sensors it can be established whether a coupling device 1 is engaged with a further coupling device 2 or not. In this way, in a train unit, which is provided with coupling devices 1,2 according to the invention, the end vehicle can be recognised in a train unit of this sort whereupon, by polling individual identifiers, the latter are stored in a corresponding central control device.

Furthermore, it is also possible however for train units or a combination of the train units and the coupling devices 1,2 to be registered on certain parts of the track or at certain monitoring points and to be stored in the control unit.

Figure 10:
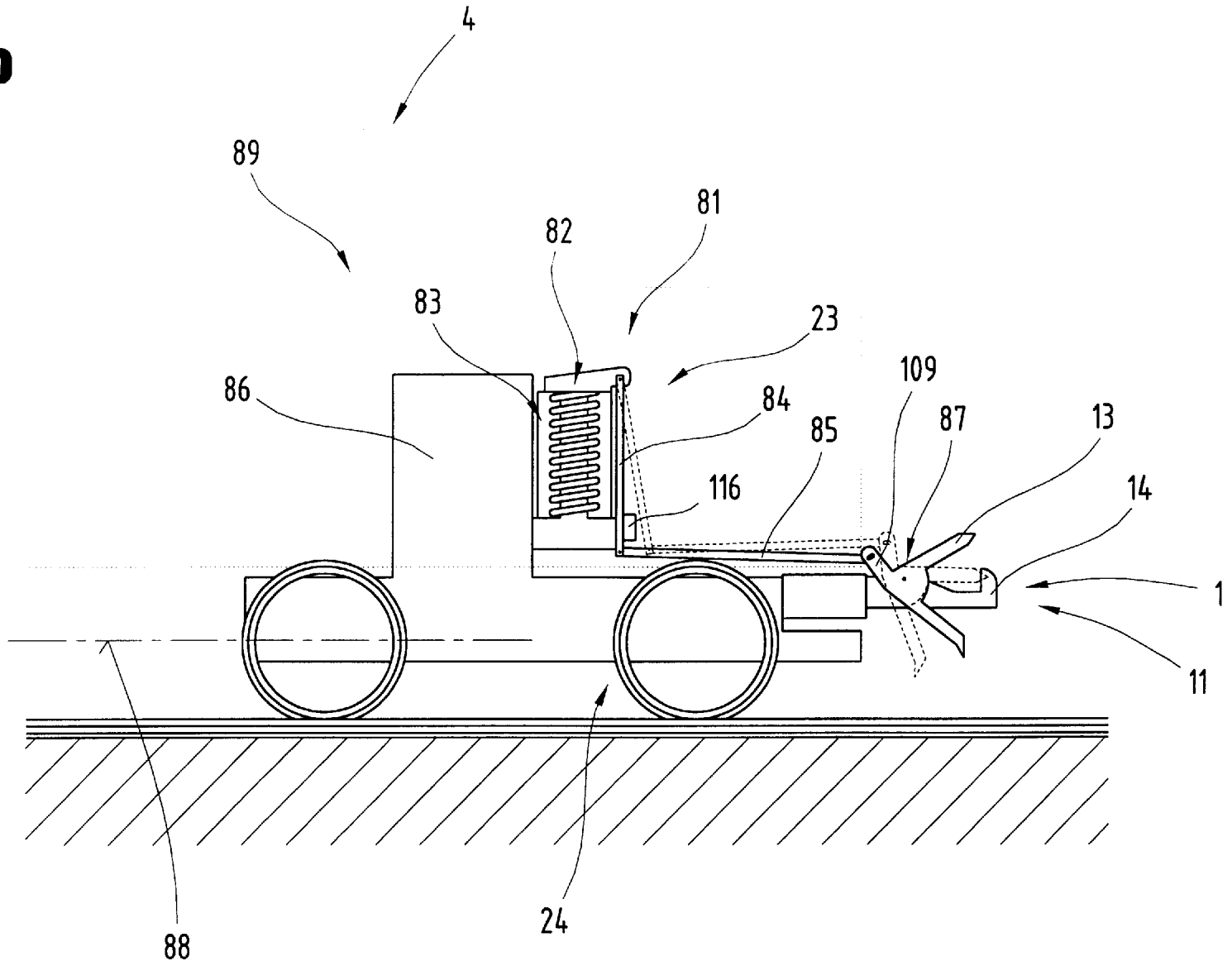
FIG. 10: a further embodiment of the coupling device with an actuating device in a vehicle as the actuation mechanism for the coupling device in simplified, schematic representation.

In FIG. 10, another type of adjustment device 23, especially an actuation device 81 is shown, which works by using electromagnetic power as an actuating mechanism for uncoupling the coupling device 1,2 and which is arranged on the vehicle 4,5.

On the vehicle 4 which is provided with the wheelset 24, a coil holder 82 of the actuating device 81 is arranged with a coil 83 and an operating element 84. The operating element 84 is connected to a connecting rod 85, the connecting rod 85 being located in the coupling bow 13 so it can pivot. The coupling bow 13 is located on the coupling head 11, which is secured to the vehicle 4 or to the chassis 86 for the wheelset 24, in a pivoting fashion. So that the coupling bow 13 can be pivoted, the latter is located on the coupling head 11 of the coupling device 1 via a pivoting axis 87. The pivoting axis 87 is arranged at an angle of 90° to the longitudinal axis 88 of the vehicle 4, so that a rotational movement of the coupling bow 13 may be carried out in the direction of the vehicle 4.

The mode of operation for uncoupling the coupling device 1 automatically is such that the coil 83 is activated with a voltage, by means of which the operating element 84 is turned on and the connecting rod 85 performs a straight-line movement in the direction of the coil 83. Because of the central positioning of the coupling bow 13, it is turned and thus opened. The coupling bow 13 is thus raised over the closing pin 14, so that the coupling parts of the coupling device 1,2 between the two vehicles 4,5 are uncoupled from one another.

The coil 83 can be operated via an alternating current harmonic wave, for example with a frequency of 1 kHz to 10 kHz, preferably 8 kHz. In an alternating voltage operation from other suppliers this alternating voltage can have a portion of direct voltage for operating the coil 83.

The coil 83 can be controlled using any means known from the state of the art. Above all, it is possible in the model railway industry for the controlling to be performed using digital decoder components. Of course, it is possible however, instead of the controlling being performed via wires, to perform the control for the activation of the coils 83 without wires also. In the shown embodiment, the actuating device 81, especially the adjustment device 23, is arranged rigidly on the chassis 86 of the vehicle 4. The chassis 86 is located flexibly thereby to the basic body 89 of the vehicle 4 so that when the vehicle 4 travels round a bend, the chassis 86 can move correspondingly to the course of the curve. Furthermore, the coupling device 1 is likewise arranged on the chassis 86, such that said coupling device 1 moves in accordance with the swivelling movement of the chassis 86 when going round bends. The coupling device 1 may however be positioned in a pivoting manner also on the chassis 86.

Figure 11:
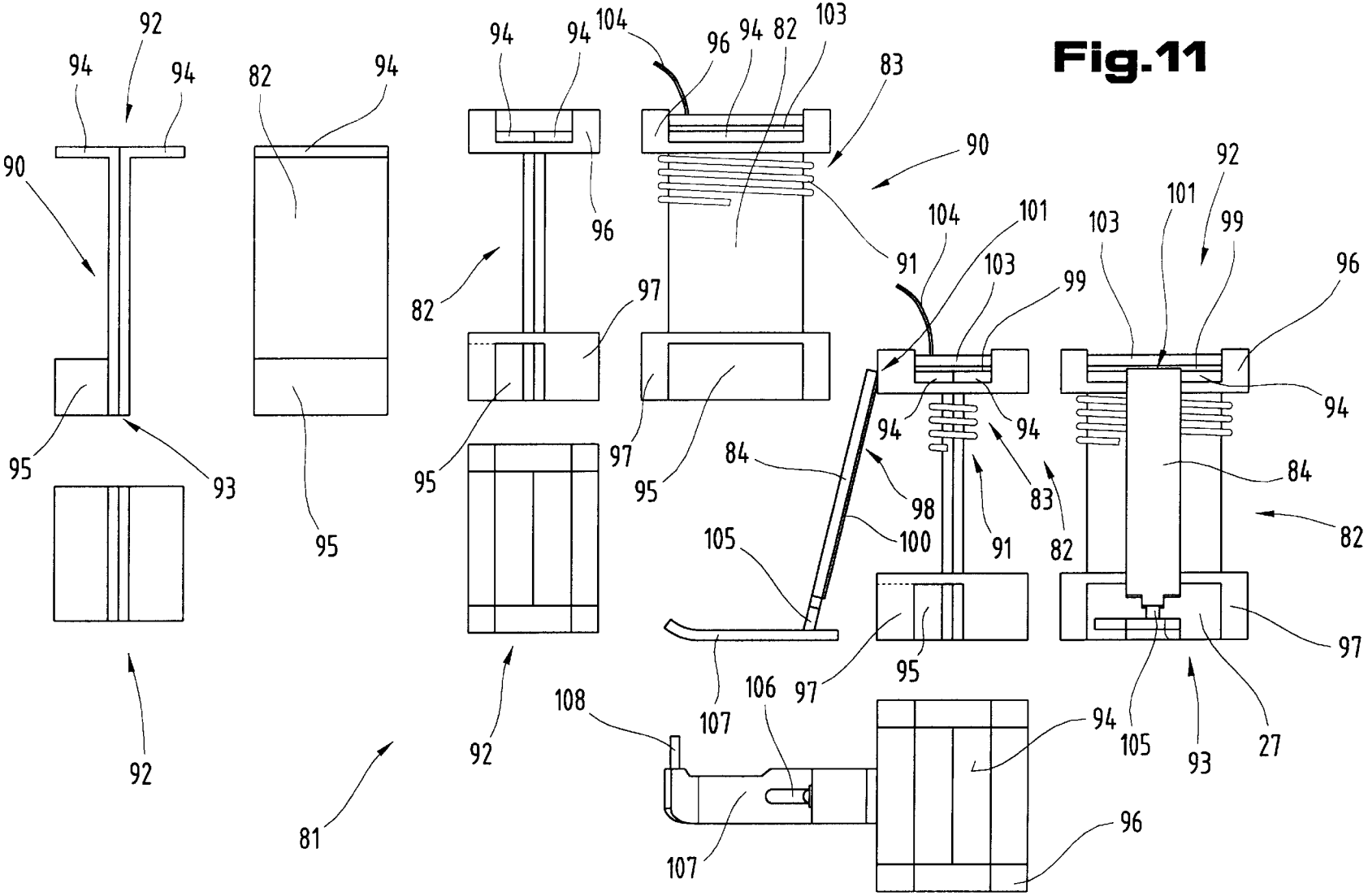
FIG. 11: another embodiment of the actuating device according to the invention in individual assembly stages.
Figure 12:
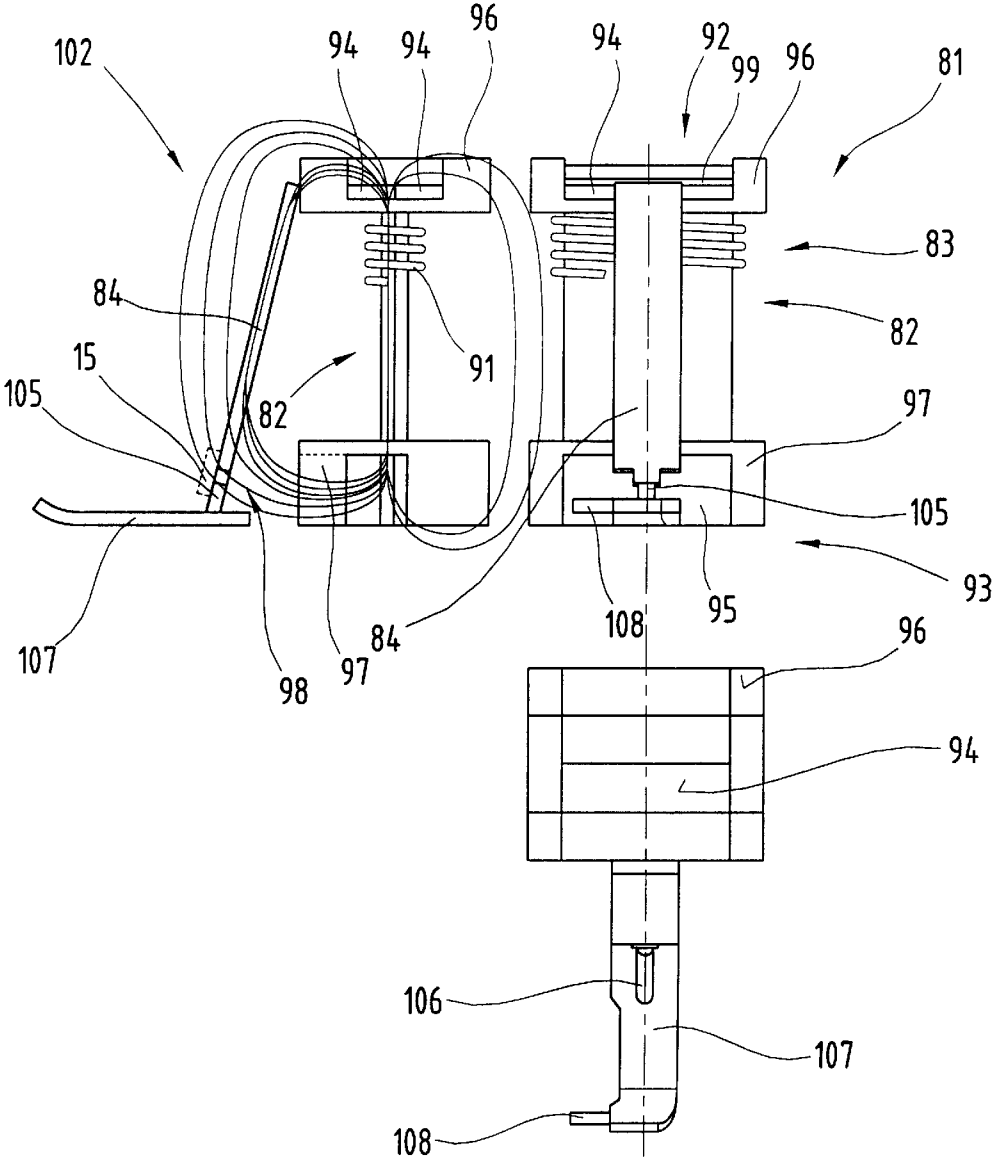
FIG. 12: an actuating device according to FIG. 11 in assembled condition, especially as an actuation mechanism for a straight-line movement.

In FIGS. 11 and 12 the actuating device 81 according to the invention is shown in detail. In this embodiment variant a coil core 90 is provided for producing a magnetic field, said core being designed at the same time as a coil bearer 82. On the coil bearer 82 the coil wire 91 for the coil 83 is wound up, reference only being made in passing.

The coil bearer 82 consists of solid material, namely iron, and has a roughly square cross section. This implies that the coil bearer 82 can be designed for example as a cuboid, of course also as a cylinder or as any polygonal rod-shaped component or cuboid. In the present embodiment, the coil core 90 or coil bearer 82 is formed from two L-shaped angled iron parts. Members 94 and 95 project above the rod-shaped spool core 90 in both front end regions 92,93 at least in the direction of the operating element 84. Out of the members 94,95, namely member 94 is formed by one of the two members 94—and indeed the shorter of the L-shaped angled iron parts. In the front end region 93 of the coil bearer 82 which faces away from the member 94, the further projecting member 95 is constructed on the side facing the operating element 84, said member 95 being formed in the present embodiment by a cuboid-shaped part which likewise consists of iron. On the side of the spool bearer 82 lying opposite the member 95 there is no further member 95. The member 95 can be attached by gluing, welding or clamping to the coil bearer 82 or the L-shaped angled iron part. The coil bearer 82 with the members 94,95 can however also be produced from solid material by mechanical processing, compression or casting.

It is of course possible however for a member 94 to be arranged likewise in the direction opposed to the member 94 projecting in the direction of the operating element 84.

A U-shaped iron core is attained by this development of the coil bearer 82 and the members 94,95. By virtue of the fact that the member 95 has a considerably greater volume than the member 94 and moreover only projects above the coil bearer 82 on one side, a concentration of field lines is achieved, which emerge in the region of this member 95 or enter into the operating element 84, and therefore, in the part of the magnetic field which is built up between the members 94 and 95, a higher magnetic force is attained for pulling in the operating element 84 in the region facing the member 95 than for example the magnetic force in the mirror-image opposite part of the coil bearer 82.

In order to assemble the coil 83, retaining clamps 96,97 are put over the L-shaped angled front end regions 92,93 as well as over the front end region 93 on the member 95. On one of the front end regions 92,93, preferably on the one which is situated opposite the member 95, a swivelling part 98 which has a bent bearing plate 99, is located. The swivelling part 98 consists of a resilient elastic and non-magnetic material, especially made of beryllides and has a number 100 which is connected preferably to a bearing plate 99 via a film hinge 101.

If beryllides are used as the material for the swivelling part 98 or a permanently elastic plastic material with sufficient memory properties which can be used as a readjusting film hinge 101, then the swivelling part 98 need not be insulated. Of course, it is also possible, however, to produce the swivelling part 98 from a resilient elastic material, for example spring steel. In this case then the parts coming into contact with the conductive parts or with the coil 83 should be provided with appropriate insulated coatings. Of course it is also possible to use sandwich components, i.e. that various materials are added to a common component.

The swivelling part 98 serves to mount the operating element 84, with which the actuation of the component which is to be moved is effected. Because of the design of the swivelling part 98 from a resilient elastic material, the hinge for swivelling the operating element 84 is constructed relative to the coil 83. This hinge has a swivelling axis which is arranged in the region of a member 94 which has a smaller volume. When current is applied to the coil 83 a magnetic field 102 is produced so that the operating element 84 is moved into its end position adjacent to the member 95 which has a greater volume.

Of course it is also possible however to provide the retaining clamps 96,97 with appropriate bearings so that the operating element 84 can be moved via its own hinge arrangement independently of the swivelling part 98. In this case then care should be taken that only the operating element 84 is appropriately insulated in the unit area at the members 94,95 and that its own readjustment arrangement is provided e.g. a leaf-spring or torsion-spring arrangement for readjusting the operating element 84 into the initial position which is away from the coil 83. If the swivelling part 98 is used, the member 100 effects the readjustment of the operating element 84 into the neutral initial position, in which the angle produced between the bearing plate 99 and the member 100 is greater than 90°. A diagonal position of the operating element 84 is thus maintained, when no current passes through the coil 83. The front end region 93 of the operating element 84 which is facing the member 95 with the greater volume is situated thus at a greater spacing from the member 94.

When current is applied to the coil 83, a magnetic field 102 builds up as is shown schematically in FIG. 12 and has the effect that the operating element 84, which is made of iron, is attracted to the member 95 which has a greater volume, by means of which the angle between the bearing plate 99 and the member 100 is reduced. Thereby an elastic restoring force is built up which has the effect of restoring the member 100 with the operating element arranged upon it into the shown resting position after disconnecting the supply of current to the coil 83.

Furthermore, the member 100 also serves as a spacing holder at the same time, if it is made from insulating material or is provided with the latter, with the result that the operating element 84 detaches reliably from the coil core 90 or from the coil 83 when the current is switched off or when it is lost from the coil 83. The operating element 84 can thus be prevented from adhering to the member 95 of the coil 83 because of the residual magnetism of the coil 83.

At the front end region 94, a circuit board 103 is also arranged for connecting the coil wires 91 with a supply cable 104.

The components for this actuating device 81 are constructed preferably in such a way that the assembly of the coil bearer 82 is possible using snap-on or clip-on connections. Because of the design of the members 94,95 of the core of the coil 83 a special configuration of magnetic field 102 is produced which exerts an increased pulling force on the operating element 84 in the region of the end of the operating element 84 which is to be moved.

These pulling forces can be attained with the coil 83 although this looped round with coil wire 91, which can have a wire size of only 0.06 mm to 0.12 mm, especially 0.07 mm to 0.1 mm. For this purpose, 12 to 30 windings are preferred, however preferably using 16 windings. Using a development of this type of coil 83, which has a length of 10 mm to 30 mm and a cross section measurement of 5×10 mm, pulling powers between 3 and 10 grams, preferably 4 to 8 grams can be achieved with displacements of 3 mm to 12 mm. The dimensions of a coil 83 of this type can be for example as follows: length 15 mm, width 10 mm, thickness 5 mm. Nevertheless, this coil 83 has such a low current consumption that, even when used for a long time it does not heat up too much, which would lead to damage in the plastic material parts when used at a short distance from the latter.

In FIG. 12 the actuating device 81 is shown, especially as an actuating element for a straight-line movement. In order to change the swivelling movement of the operating element 84 into a straight-line movement, the operating element 84 has a pin 105 on its free end, said pin engaging in a longitudinal hole 106 of a connecting rod 107. The straight-line movement can be correspondingly switched over to, via a cranked carrier 108, which is arranged on the connecting rod 107. If the movement is adopted in the model railway construction for uncoupling the coupling device 1,2, the carrier 108 engages, for example, in a corresponding pulling bow 109 which is connected while moving to the coupling bow 13, as is shown schematically in FIG. 10.

Figure 13:
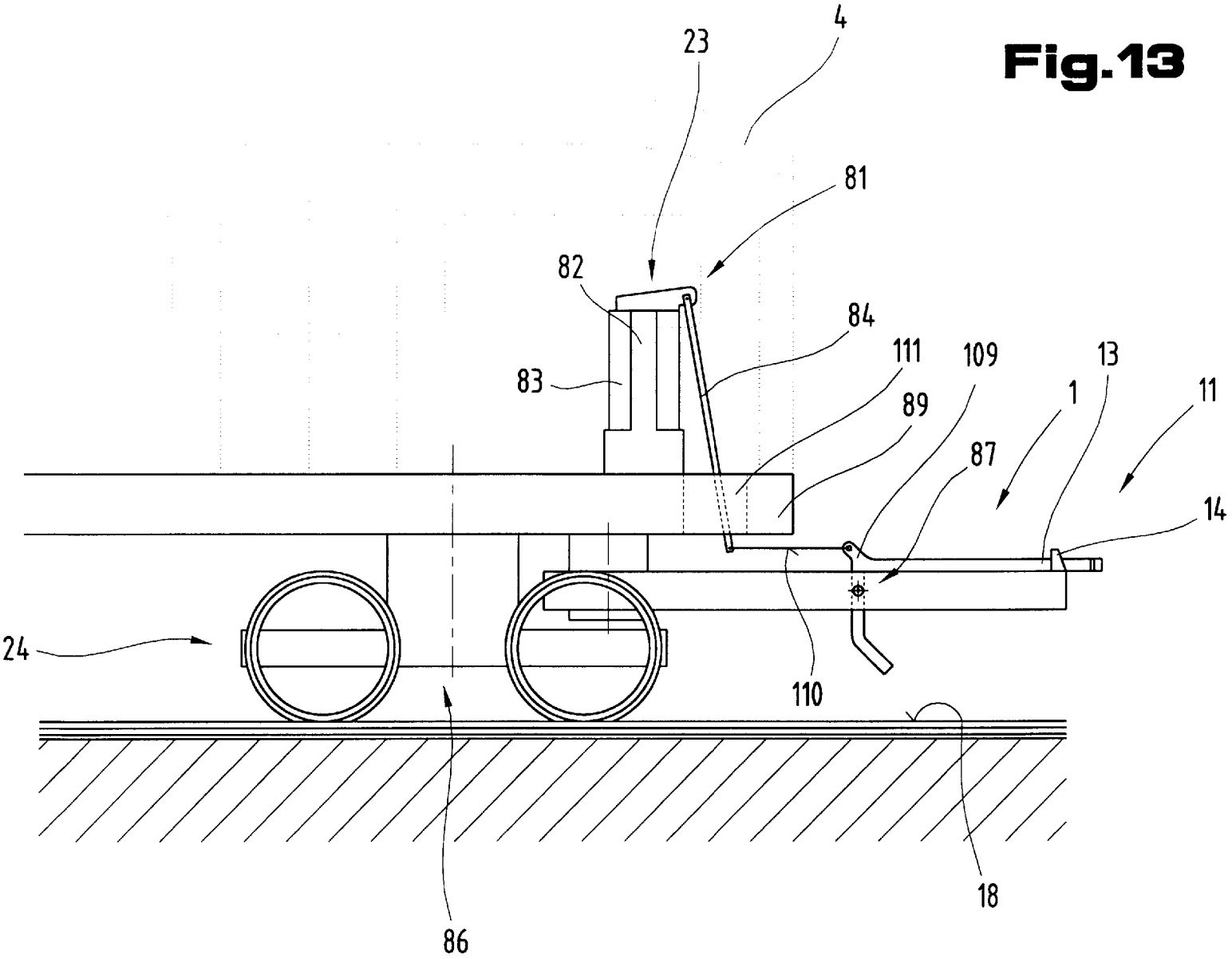
FIG. 13: a further embodiment of the coupling device with the actuating device in a vehicle as an actuating mechanism for a coupling device in simplified, schematic representation.

In FIG. 13, another embodiment for the use of the adjustment device 23, particularly of the actuating device 81, is shown.

In this embodiment the coupling device 1 is now positioned independently of the chassis 86 on the basic body 89 of the vehicle 4 so it can swivel. The chassis 86 with the wheelset 24 is likewise positioned rotatably to the basic body of the vehicle 4.

The coupling device 1 is once again formed by the coupling bow 13 which is positioned rotatably via the swivelling axis 87 on the coupling head 11. Furthermore, the coupling device 1 has the closing pin 14 for engaging the further coupling bow 13 of the further coupling device 2 of a further vehicle 5.

So that the two vehicles 4,5, which are coupled together, may be uncoupled automatically, the pulling bow 109 is arranged on the coupling bow 13. The pulling bow 109 is connected via a pulling element, which has tensile strength but is otherwise elastically deformable, for example a cable 110, to the operating element 84 of the actuating device 81.

The actuating device 81 is secured in the interior of the vehicle 4 to the basic body 89 in this embodiment. This attachment can be made rigid. The actuating device 81 can be arranged on the basic body 89, or also adjustably on a pivoting axis. In order to connect the operating element 84 to the pulling bow 109, the operating element 84 extends via an opening 111 through the basic body 89 and projects over the latter in the direction of the contact surface 18 of the vehicle 4. Of course, it is also possible for the cable 110 to be directed via appropriate deflection members or rollers into the inner space of the vehicle 4 so that a special design for the operating elements 84 is not required.

The mode of operation for automatically uncoupling the coupling devices 1 and 2 corresponds to the mode of operation which is shown in the embodiment in FIG. 10 and is therefore not dealt with in more detail.

The advantage of a design of this type, then lies in the fact that, on the basis of the arrangement of the actuating device 81 in the interior of the vehicle 4, the outer form or the dimensions of the construction size do not have to be considered, since there is sufficient space available in the interior of the vehicle 4 for arranging an actuating device 81 of this type. It is possible, therefore, for the coil 83, in particular the coil bearer 82, to be of larger dimensions, so that the pulling force for the adjusting lever 84 can be increased resulting in a reliable uncoupling of both coupling devices 1 and 2.

Of course it is possible, instead of using a cable 110 for connecting the adjusting lever 84 to the pulling bow 109, to use a connecting rod 85 once again. This connecting rod must however, in a construction of this type, be hinged rotatably to the adjusting lever 84 and the pulling bow 109, so that while going round curves, i.e. when the coupling device 1 rotates corresponding to the course of the rails, the connecting rod 85 can be moved relative to the coupling head 11 and the actuating device 81.

Reference may be made as a matter of form only to the fact that the retainer 19,20 is likewise provided in the further embodiment variants also for the purpose of securing the coupling bow 13 preferably in its coupled position.

However, it is also possible in all the embodiment variants that a solution can be achieved without this retainer 19,20.

Amongst other things, it is also possible, of course, to use a coupling head 11, as is described in DE 40 35 578 A1 in detail, for the reason that the entire contents of this DE 40 35 578 A1 are contained in this application. Particularly concerning the layout, the arrangement and the design of the coupling bow 13 and also of the retainer 19,20.

However, the present invention is not fundamentally bound to any particular configuration of the coupling device 1,2 and can therefore be used for all coupling devices 1,2 which are used in the sphere of models for vehicles 4,5, be these for railway vehicles, trams, trolley buses or similar.

Figure 2:
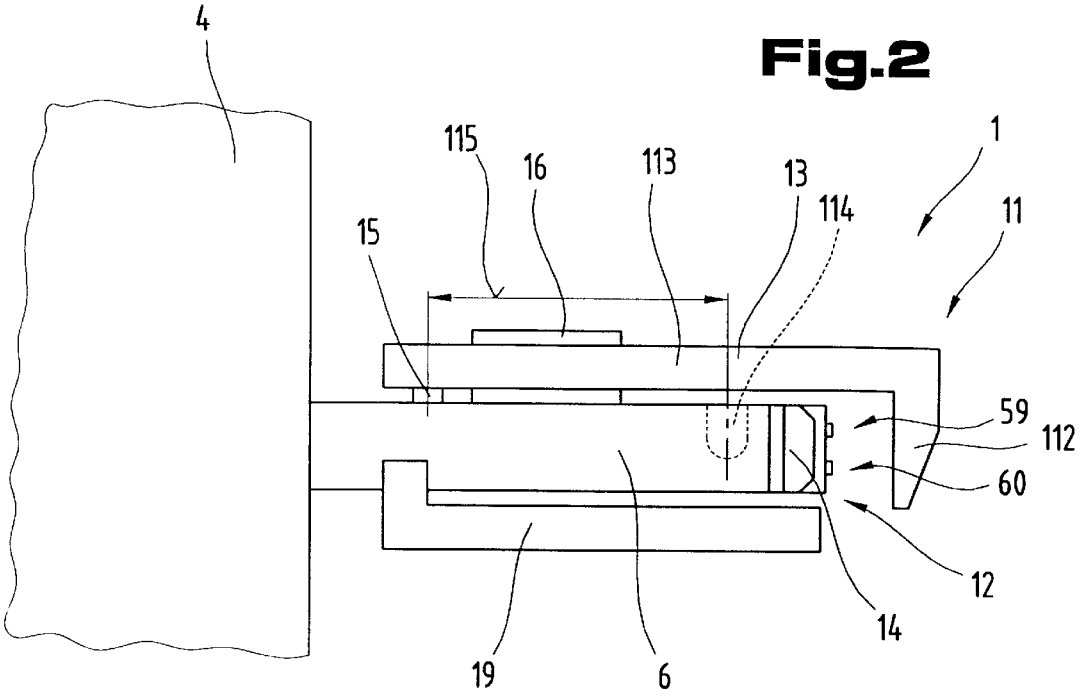
FIG. 2: one of the coupling devices according to FIG. 1 in plan view and simplified, schematic representation.
Figure 3:
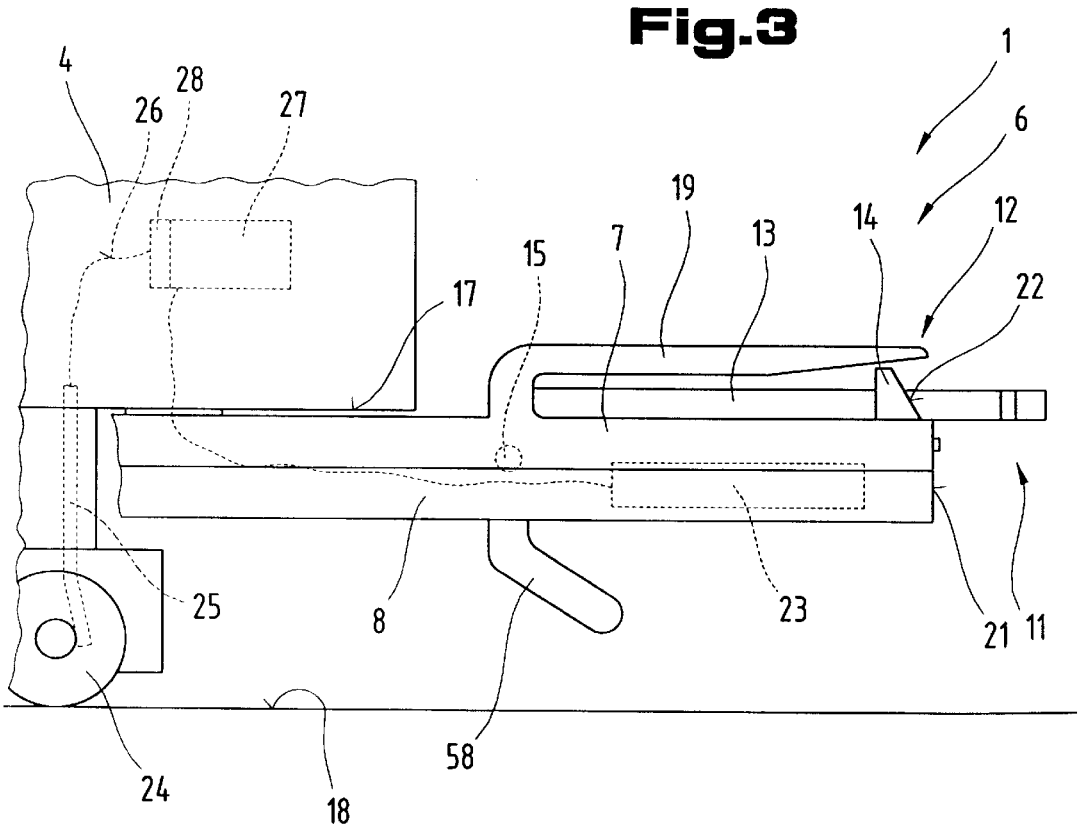
FIG. 3: the coupling device according to the invention on the vehicle, in side view and simplified, schematic representation.

However, in order to make it possible to raise both coupling bows 13 reliably, particularly when each coupling head 11 is provided with a coupling bow, of no matter what type, and although only one of the coupling bows 13 is connected directly to the actuating device 81 or the adjustment device 23, a carrier 114 can be arranged, as is shown schematically in FIGS. 1 and 2 with dotted lines, between a coupling projection 112, engaging the closing pin 14 from behind, and the pivoting axis 15 on a sleeper 113; said carrier being arranged also from the latter in the direction of the coupling housing 6 on the side facing away from the contact surface 18 of the vehicles 4,5 and projecting above or overlapping the coupling housing 6 in part. This carrier 114 is arranged on the sleeper 113 at such a spacing 115 from the swivelling axis 15 which corresponds to the same spacing between the swivelling axis 15 and the coupling projection 112 of the further coupling device 2, when the coupling devices 1,2 are in coupling engagement as is shown in FIG. 1.

By means of this, it can be ensured that, when the coupling bow 13 is swung up round the pivoting axis 15, not only the coupling projection 112 of the coupling bow 13, which is connected to the actuating device 81, is raised but also, during the raising procedure, the coupling projection 112 of the coupling device 2 of the further vehicle 5 is raised at the same time and thus disengages from the closing pin 14. Thus when the coupling bow 13 is lifted up, the vehicles 4,5 can be separated by the relative movement of both, but on the other hand, as long as the actuation device 81 or the adjustment device 23 is activated with power, it is also possible to push vehicle 5 with vehicle 4 and in this way, a fly shunting can also be realised which is very close to reality. Because of the arrangement of this carrier 114, uncoupling the coupling devices 1,2, which do not have an exactly similar construction, is also simplified or actually made possible at all.

In order to control the actuating device 81, the same elements can of course be used as those already described at the beginning for controlling the adjustment device 23. A control of this type via harmonic waves in a direct current basic supply or via a direct voltage component in an alternating current supply is just as possible as the activation of the coil 83 by control via digital or numerically actuated components as it is used at present in model railways, predominantly for independent train vehicle control. In this case, each actuation device 81 having its own actuating device 81 or one arranged for all of them on one vehicle 4,5, receives a common or different identification so that via the bus system and the respective identification, any vehicle 4,5 travelling on a model railway unit can be controlled or activated.

Of course, it is also possible in the framework of the invention for the retainers 19, 20 to be activated via a transmission element e.g. a pulling element, such as the cable 110 or the connecting rod 85 for example in the sense of an opening movement.

In order to increase the pulling power in relatively high adjustments of the actuating device 81, it is also possible, amongst other things, to provide the operating element 84 with an additional permanent magnet 116 as is shown schematically in FIG. 10.

Figure 14:
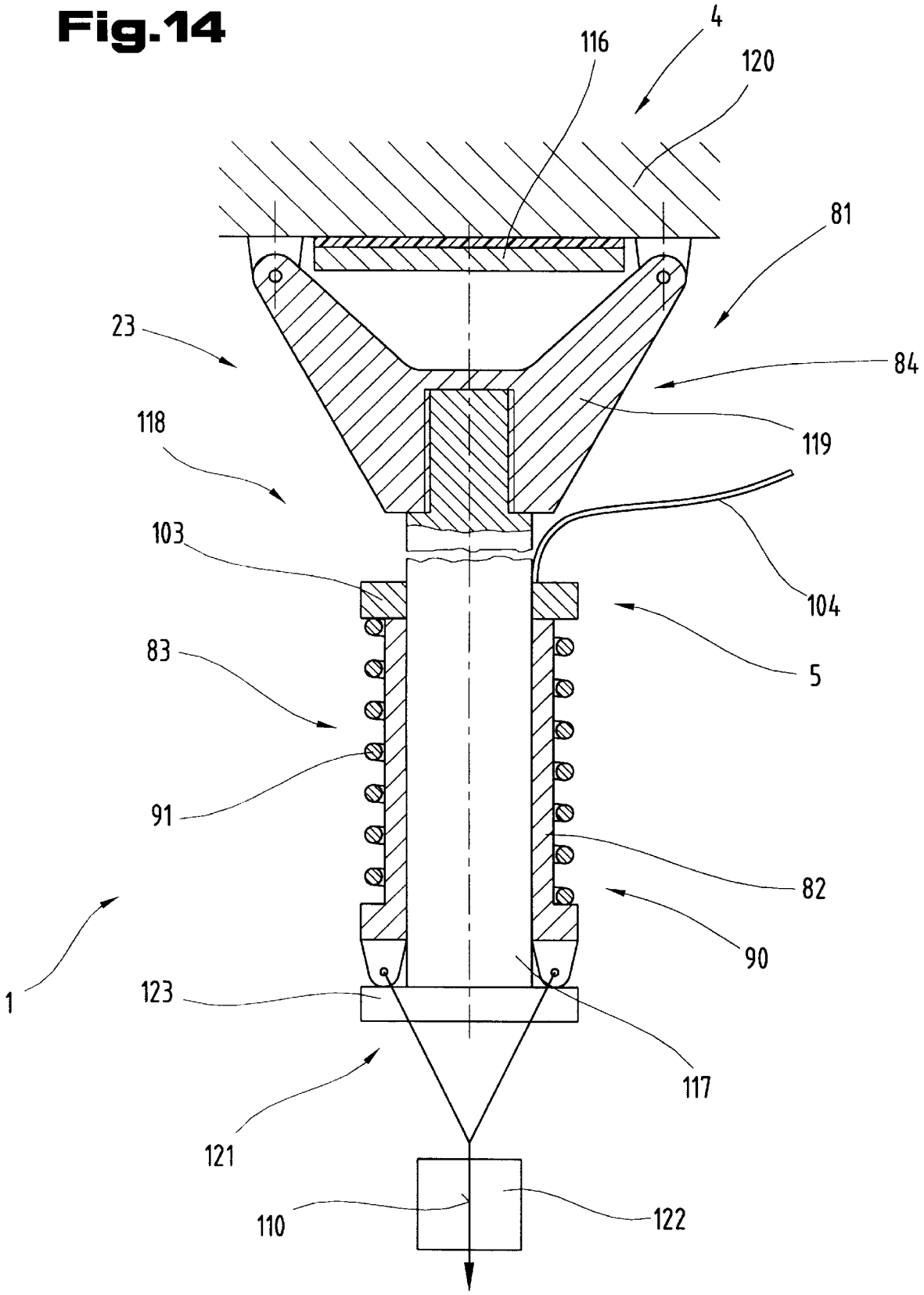
FIG. 14: another embodiment of the coupling device with the actuating device according to the invention in simplified, schematic representation.

As shown further in FIG. 14, it is also possible, of course, to construct the actuating device 81 as a cylinder-shaped coil 83 rather than a cuboid-shaped design, the pulling force of this cylinder-shaped coil 83 being increased by the arrangement of the additional permanent magnet 116.

The actuation device 81 has the coil core 90, which is constructed preferably as a guiding mandrel 117. The coil bearer 82 on which the coil 83 is taken up is arranged adjustably on this coil core 90.

On the front side 118 of the coil bearer 82 the circuit board is situated for connecting the coil wires 91 to the connecting cable 104. The guiding mandrel 117 which is used as the coil core 90 is situated on one end via a securing element 119 on a component 120 of the vehicle 4, rigidly or moveably attached or rotatably. In the coil core 90 the operating element 84 is located adjustably.

In order to produce a movement, the coil 83 is activated with voltage, a magnetic field being produced by the voltage in the coil 83. The coil bearer 82 with the coil 83, which is on the operating element 84, which is produced from various materials, preferably iron, moves in the direction of the circuit board 103, which is arranged in the region of a front side 118 of the coil bearer 82. On the front side 121 of the coil bearer 82 lying opposite the circuit board 103 there is a restoring unit 122; this restoring unit 122 being a spring, the weight of the component itself, or similar. At the same time, the coil bearer 82 is connected via a pulling element, such as the cable 110 or the connecting rod 85 for example, to the connecting device 1, as is shown schematically. The readjustment of the coil 83 into the initial position only results when the supply of power to the coil 83 comes to an end. In this way, the coil 83 then adjoins the schematically described coil bearer 82 in the direction of the restoring unit 122 and the limiting limit stop, for example adjoining a collar of the guiding mandrel 117. In the development of the coil 83, it is possible to produce magnetic fields with different configurations using different numbers of windings along the length of the coil 83.

In order to increase the adjustment power, with which the coil bearer 82 can be adjusted, above the scale of that adjustment power which can be achieved by the coil 83, a permanent magnet 116 is arranged in the front side of the guiding mandrel 117 which faces away from the restoring unit 122. Care must be taken in this arrangement of the permanent magnet 116 that its polarity is designed, at the side facing towards the coil 83, in such a way that, when current is applied to the coil 83, a varying polarity is available on the side of the coil 83 facing towards the permanent magnet 116 so that the permanent magnet 116 and the coil 83 are attracted to one another. By means of this additional attractive power of the permanent magnet 116, the adjustment power is increased against the restoring unit 122 and thus a considerably greater adjustment power can be exerted on a component or an adjustment organ than would be the case when using the coil 83 exclusively, for example. The adjustment movement of the coil 83 in the direction of displacement is likewise supported by the permanent magnet 116 and the adjustment power is concentrated in the direction of displacement, so that the coupling bow 13 can be raised.

It is therefore possible with coils which are smaller in construction or have fewer windings and which also do not experience strong increases in temperature during longer current load, to bring about considerably higher adjustment power in correspondingly large adjustments than was the case with coils 83 known to date.

It is of advantage thereby if the permanent magnet 116 is arranged in the guiding mandrel 117 or in the end position of the coil 83 which is nearer the permanent magnet 116 or if it forms an end limit stop at all; a non-conductive material being arranged to avoid the coil 83 adhering to the permanent magnet 116, between the said coil 83 and the permanent magnet 116.

It is also advantageous in this solution, that, during diametrically opposed activation of the coil 83, the relative movement for movements away from the permanent magnet 116 can be likewise supported, since, on both sides of the coil 83 facing one another, the same polarity can be present. Of course, it is also possible, when adjusting the limit stops 123 for limiting the relative movement between the coil 83 and the guiding mandrel 117, that the position of the permanent magnet 116 can also be respectively altered, so that the spacing between the end position and the permanent magnet can be optimised for making the best possible use of the additional pulling power.

Furthermore, it is also useful, if the permanent magnet 116 is arranged in a plane which is perpendicular to the guiding mandrel 117. It has thereby been proven to be particularly advantageous if the permanent magnet 116 is arranged concentrically to the longitudinal axis of the guiding mandrel 117. The largest possible power support in the adjustment movement of the coil 83 can be achieved when the permanent magnet 116 is designed as a flat component, especially as a disc.

It is also advantageous, if the permanent magnet is arranged via an insulator or via an air gap at a distance from the components of the actuating device 81, which are made of metal, particularly at a distance from the guiding mandrel 117 which is made of metal and/or from the snap lock or the component storing the permanent magnet 116, in order to prevent a reduction in the magnetic power of the permanent magnet 116 occurring.

A possible embodiment variant would also arise if the permanent magnet 116 is constructed as a concentric ring magnet surrounding the guiding mandrel 117. Care would of course have to be taken then above all to have an appropriate insulating screen between the guiding mandrel 117 and the permanent magnet 116 in order to keep down the frictional forces between the permanent magnet 116 and the guiding mandrel 117 as far as possible.

In a development of this type for an actuating device 81 it is thus possible, to arrange the latter by lengthening the operating movement virtually parallel to the base of the vehicle. An actuating device 81 of this type can therefore be used preferably in wagons, which are designed without their own actuating element since, in a simple form, the actuating device 81 can be integrated into the basic frame of this type of vehicle 4,5.

Above all, a design of this type for an actuating device 81 can also be built immediately into the coupling housing 6 for the coupling device 1,2.

As a matter of form, reference may be made in conclusion to the fact that, for better understanding of the design of the coupling device 1,2, the latter or its components are represented partly out of scale and enlarged. Individual characteristics of the combinations of features which are shown in the individual embodiments respectively can create a solution according to the invention on their own behalf.

In conclusion, reference can be made to the fact that in the previously described embodiments individual parts are shown disproportionately enlarged in order to improve understanding of the solution according to the invention. Furthermore, individual parts of the previously described combinations of features of the individual embodiments in conjunction with other individual characteristics from other embodiments can create solutions according to the invention on their own behalf.

Above all, the embodiments which are shown in FIGS. 1 to 5; 6 to 8; 9; 10; 11, 12; 13; 14; create the object of independent solutions according to the invention. The objects and the solutions of concern according to the invention can be taken from the detailed descriptions of these Figures.

What is claimed is:

1. Coupling device adapted for use on a model railway vehicle for coupling the model vehicle to another model vehicle equipped with another coupling device, the coupling device comprising a closing element and a coupling head, the coupling head being movable into a position for engaging the closing element of the other coupling device from behind, characterised in that the coupling device includes an adjustment device that is operable upon activation thereof to move at least one of the coupling head and the closing element of the coupling device relative to the other for automatically connecting and disconnecting the coupling device from the other coupling device, wherein the coupling device includes an operating element connected with the coupling head for moving the coupling head so as to disconnect the coupling device, and wherein the adjustment device comprises an electromagnet having a coil for producing a magnetic field, the operating element being disposed adjacent the coil and being magnetically attractable by the coil for producing relative movement between the coil and the operating element, and wherein the coupling device includes a permanent magnet arranged adjacent the coil for magnetically assisting the relative movement between the coil and the operating element.

2. Coupling device according to claim 1, characterised in that the coil is wound round with coil wire, which has a wire size of 0.06 to 0.12 mm, and the coil has 12 to 30 windings.

3. Coupling device according to claim 1, characterised in that the coil includes a coil wire wound about a coil bearer, and wherein the coil bearer has a circuit board for connecting the coil wires to a connecting cable.

4. Coupling device according to claim 1, characterised in that the wire size for the coil is 0.04 mm to 0.1 mm.

5. Coupling device according to claim 1, characterised in that the coil can be operated via an alternating current harmonic wave.

6. Coupling device according to claim 5, characterised in that, during an alternating current operation for operating the coil, the alternating current has a direct current portion.

7. Coupling device according to claim 1, characterised in that, in model railway construction, for the purpose of uncoupling the coupling device, the coupling head includes a movable coupling bow and the operating element actuates one of an adjusting lever, a connecting rod, and a cable which is connected to the coupling bow.

8. Coupling device according to claim 1, characterised in that the coil with the operating element is adapted to be arranged on a vehicle.

9. Coupling device according to claim 1, characterised in that the coil includes a coil bearer and the permanent magnet is arranged at a distance from an end of the coil bearer.

10. Coupling device according to claim 1, characterised in that the coil includes a coil core designed as a guiding mandrel and the coil with the coil bearer surrounds the guiding mandrel and is movable therealong for causing movement of the operating element.

11. Coupling device according to claim 10, characterised in that the permanent magnet is arranged facing one end of the coil on the guiding mandrel for attracting the coil so as to assist in moving the coil and coil bearer along the guiding mandrel.

12. Coupling device according to claim 11, characterised in that the guiding mandrel extends along a longitudinal axis and the permanent magnet is arranged in a plane which is perpendicular to the longitudinal axis of the guiding mandrel and concentric to the longitudinal axis of the guiding mandrel.

13. Coupling device according to claim 1, characterised in that the permanent magnet is secured or held at a distance from the guiding mandrel which is made of metal.

* * * * *